United States Patent [19]

Lysy et al.

[11] Patent Number: 5,047,165

[45] Date of Patent: Sep. 10, 1991

[54] FINE FABRIC LAUNDRY DETERGENT WITH SUGAR ESTERS AS SOFTENING AND WHITENING AGENTS

[75] Inventors: Regis Lysy, Olne; Marie-Helene Fraikin, Hermee, both of Belgium

[73] Assignee: Colgate-Palmolive Co., Piscataway, N.J.

[21] Appl. No.: 302,168

[22] Filed: Jan. 25, 1989

[51] Int. Cl.[5] ..... C11D 1/831; C11D 9/32

[52] U.S. Cl. ..... 252/121; 252/548; 252/156; 252/551; 252/558; 252/553; 252/559; 252/174.17; 252/174.18; 252/DIG. 14; 252/8.6

[58] Field of Search ..... 252/135, 89.1, 174.17, 252/174.18, 826, 548, 156, 551, 558, 559, 121

[56] References Cited

U.S. PATENT DOCUMENTS

| | | | |
|---|---|---|---|
| 2,970,962 | 2/1961 | Hass et al. | 252/135 |
| 3,872,020 | 3/1975 | Yamagishi et al. | 252/174.18 |
| 3,925,224 | 12/1975 | Winston | 252/559 |
| 4,395,365 | 7/1983 | Hasegawa et al. | 252/545 |
| 4,490,285 | 12/1984 | Kebanli | 252/551 |
| 4,800,038 | 1/1989 | Broze et al. | 252/174.17 |

FOREIGN PATENT DOCUMENTS

| | | |
|---|---|---|
| 1467705 | 11/1970 | Fed. Rep. of Germany . |
| 11804 | 4/1973 | Japan . |
| 39707 | 4/1975 | Japan . |
| 119812 | 9/1975 | Japan . |
| 55306 | 5/1976 | Japan . |

*Primary Examiner*—Prince E. Willis

*Attorney, Agent, or Firm*—Bernard Lieberman; Murray M. Grill; Robert C. Sullivan

[57] ABSTRACT

A non-bleaching fine fabric detergent composition comprises a detersively effective amount of a mixture of anionic and nonionic surfactants, a detergent building effective amount of at least one builder salt, and a softening and whitening effective amount of a sugar ester containing at least one fatty acid chain. In a preferred embodiment, the composition is in the form of an aqueous liquid composition.

20 Claims, 2 Drawing Sheets

FINE FABRIC LAUNDRY DETERGENT WITH SUGAR ESTERS AS SOFTENING AND WHITENING AGENTS

BACKGROUND OF THE INVENTION

1. Field of the Invention

This invention relates to a fine fabric laundry detergent composition. More particularly, the invention is directed to a fine fabric detergent composition having incorporated therein a sugar ester which provides both softening and whitening properties to the detergent composition A. preferred embodiment of the invention is directed to an aqueous liquid fine fabric laundry detergent composition.

2. Description of the Prior Art

The use of various sugar derivatives in laundry detergent compositions is known.

It is well known in the art that certain alkyl glycosides, particularly long chain alkyl glycosides, are surface active and are useful as nonionic surfactants in detergent compositions. Lower alkyl glycosides are not as surface active as their long chain counterparts. Alkyl glycosides exhibiting the greatest surface activity have relatively long-chain alkyl groups. These alkyl groups generally contain about 8 to 25 carbon atoms and preferably about 10 to 14 carbon atoms.

Long chain alkyl glycosides are commonly prepared from saccharides and long chain alcohols. However, unsubstituted saccharides such as glucose are insoluble in higher alcohols and thus do not react together easily. Therefore, it is common to first convert the saccharide to an intermediate, lower alkyl glycoside which is then reacted with the long chain alcohol. Lower alkyl glycosides are commercially available and are commonly prepared by reacting a saccharide with a lower alcohol in the presence of an acid catalyst. Butyl glycoside is often employed as the intermediary.

The use of long chain alkyl glycosides as a surfactant in detergent compositions and various methods of preparing alkyl glycosides is disclosed, for example, in U.S. Pat. Nos. 2,974,134; 3,547,828; 3,598,865 and 3,721,633. The use of lower alkyl glycosides as a viscosity reducing agent in aqueous liquid and powdered detergents is disclosed in U.S. Pat. No. 4,488,981.

Acetylated sugar esters, such as, for example, glucose penta acetate, glucose tetra acetate and sucrose octa acetate, have been known for years as oxygen bleach activators. The use of acetylated sugar derivatives as bleach activators is disclosed in U.S. Pat. Nos. 2,955,905; 3,901,819 and 4,016,090.

SUMMARY OF THE INVENTION

In accordance with the present invention, a non-bleaching fine fabric detergent composition is provided which comprises

- a detersively effective amount of a surfactant selected from the group consisting of anionic surfactants, nonionic surfactants and a mixture of anionic and nonionic surfactants;
- a detergent building effective amount of at least one builder salt; and
- a softening and whitening effective amount of a sugar ester containing at least one fatty acid chain.

The sugar esters act as softening and whitening agents, and may be incorporated into detergent compositions which may be formulated into liquid or powdered form.

Most softening agents incorporated into a detergent are detrimental to cleaning performance. It has now been found that the presently contemplated sugar esters, when formulated as disclosed herein in a detergent composition, work as an effective softening agent and as effective antiredeposition agents and improve the whitening performance of the fine fabric detergent. In this regard, the sugar esters provide a documentable softness to cotton fabric. Moreover, the sugar esters improve the whitening properties when cleaning different fabrics such as cotton, polyester/cotton blends, nylon and wool. These effects are believed to be due to the excellent wetting and dispersing properties of the sugar esters. Also, the hydrophilic portion of the sugar ester molecule is believed to be able to interact with cotton fibers.

The use of the sugar esters in the presently contemplated compositions provide a detergent with, simultaneously, a softening effect and an overall better cleaning performance. The sugar esters, being biodegradable, also provide an ecologically desirable product.

The presently contemplated sugar esters, when combined with the conventional anionic and nonionic surfactants utilized in the present formulations, reduce the irritation index of these surfactants. This is of special interest in hand washing operations using a fine fabric detergent.

BRIEF DESCRIPTION OF THE DRAWING FIGURES

DETAILED DESCRIPTION OF THE INVENTION

Figure 1:
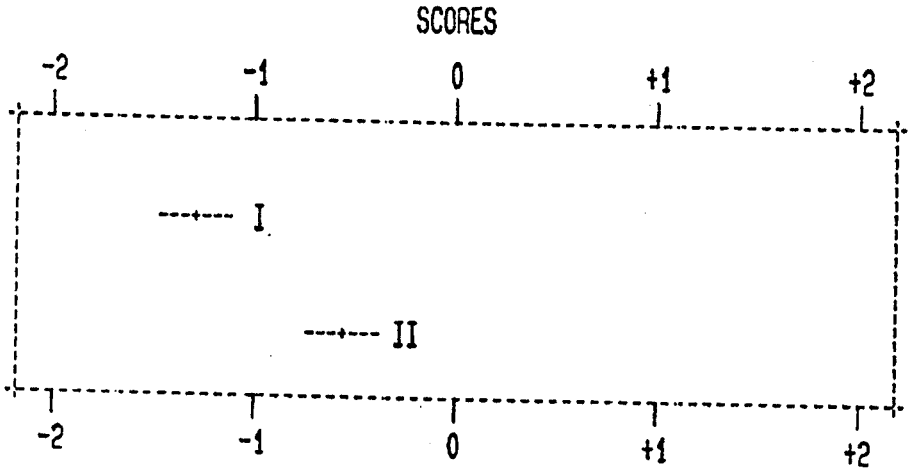
FIG. 1 is a graphical illustration of whiteness/redeposition values of fine fabric detergent compositions on cotton.

The detergent compositions of the present invention preferably employ one or more anionic surfactant compounds as the primary surfactants. The anionic surfactant is preferably supplemented with another type of surfactant, preferably a nonionic surfactant.

Among the anionic surface active agents useful in the present invention are those surface active compounds which contain an organic hydrophobic group containing from about 8 to 26 carbon atoms and preferably from about 10 to 18 carbon atoms in their molecular structure and at least one water-solubilizing group selected from the group of sulphonate, sulphate, carboxylate, phosphonate and phosphate so as to form a water-soluble detergent.

Examples of suitable anionic surfactants include soaps, such as, the water-soluble salts (e.g. the sodium, potassium, ammonium and alkanolammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil, palm kernel oil (also known as palm nut oil or palm oil) and mixtures thereof. Particularly useful are the sodium and potassium salts of the fatty acid mixtures derived from coconut oil and tallow, for example, sodium coconut soap and potassium tallow soap.

The anionic class of surfactants also include the water-soluble sulphated and sulphonated surfactants having an aliphatic, preferably an alkyl, radical containing from about 8 to 26, and preferably from about 12 to 22 carbon atoms. (The term "alkyl" incudes the alkyl portion of the higher acyl radicals.) Examples of the sulphonated anionic surfactants are the higher alkyl mononuclear aromatic sulphonates, wherein the mononuclear aromatic group contains 6 to 9 carbon atoms, such as the higher alkyl benzene sulphonates containing from about 10 to 16 carbon atoms in the higher alkyl group in a straight or branched chain, such as, for example, the sodium, potassium and ammonium salts of higher alkyl benzene sulphonates, higher alkyl toluene sulphonates and higher alkyl phenol sulphonates.

Other suitable anionic surfactants are the olefin sulphonates including long chain alkene sulphonates, long chain hydroxyalkane sulphonates or mixtures of alkene sulphonates and hydroxyalkane sulphonates. The olefin sulphonate surfactants may be prepared in a conventional manner by the reaction of sulphur trioxide ($SO_3$) with long chain olefins containing from about 8 to 25, and preferably from about 12 to 21 carbon atoms, such olefins having the formula $RCH{=}CHR^1$ wherein R represents a higher alkyl group of from about 6 to 23 carbons and $R^1$ represents an alkyl group containing from about 1 to 17 carbon atoms, or hydrogen to form a mixture of sultones and alkene sulphonic acids which is then treated to convert the sultones to sulphonates. Other examples of sulphate or sulphonate surfactants are paraffin sulphonates containing from about 10 to 20 carbon atoms, and preferably from about 15 to 20 carbon atoms. The primary paraffin sulphonates are made by reacting long chain alpha olefins and bisulphites. Paraffin sulphonates having the sulphonate group distributed along the paraffin chain are shown in U.S. Pat. Nos. 2,503,280; 2,507,088; 3,260,741; 3,372,188 and German Patent No. 735,096.

Other suitable anionic surfactants are sulphated ethoxylated higher fatty alcohols of the formula $RO(C_2H_4O)_mSO_3M$, wherein R represents a fatty alkyl group of from 10 to 18 carbon atoms, m is from 2 to 6 (preferably having a value from about 1/5 to ½ the number of carbon atoms in the R group) and M is a solubilizing salt-forming cation, such as an alkali metal, ammonium, lower alkylamino or lower alkanolamino, or a higher alkyl benzene sulphonate wherein the higher alkyl group is of 10 to 15 carbon atoms. The proportion of ethylene oxide in the polyethoxylated higher alkanol sulphate is preferably 2 to 5 moles of ethylene oxide groups per mole of anionic detergent, with three moles being most preferred, especially when the higher alkanol is of 11 to 15 carbon atoms. To maintain the desired hydrophile-lipophile balance, when the carbon atom content of the alkyl chain is in the lower portion of the 10 to 18 carbon atoms range, the ethylene oxide content of the detergent may be reduced to about two moles per mole whereas when the higher alkanol is of 16 to 18 carbon atoms in the higher part of the range, the number of ethylene oxide groups may be increased to 4 or 5 and in some cases to as high as 8 to 9. Similarly, the salt-forming cation may be altered to obtain the best solubility. It may be any suitably solubilizing metal or radical but will most frequently be an alkali metal, e.g. sodium, or ammonium. If lower alkylamine or alkanolamine groups are utilized, the alkyl groups and alkanols will usually contain from 1 to 4 carbon atoms and the amines and alkanolamines may be mono-, di- and tri-substituted, as in monoethanolamine, di-isopropanolamine and trimethylamine. A preferred polyethoxylated alcohol sulphate surfactant is available from Shell Chemical Company and is marketed as Neodol® 25-3S.

The most highly preferred water-soluble anionic surfactant compounds are the ammonium and substituted ammonium (such as mono-, di- and tri-ethanolamine), alkali metal (such as sodium and potassium) and alkaline earth metal (such as calcium and magnesium) salts of the higher alkyl benzene sulphonates.

Most preferably, a mixture of anionic surfactants is utilized, such as a mixture of: (a) a higher alkyl mononuclear aromatic sulphonate wherein the higher alkyl group contains 10 to 16 carbon atoms and the mononuclear aromatic group contains 6 to 9 carbon atoms; (b) a soap of a fatty acid containing from about 8 to 20 carbon atoms; and (c) a sulphated ethoxylated higher fatty alcohol of the formula $$RO(C_2H_4O)_mSO_3M$$

wherein R represents a fatty alkyl group of from 10 to 18 carbon atoms, m is from 2 to 6 and M is a solubilizing salt-forming cation.

Preferably, the mixture of anionic surfactants comprises 50 to 85% by weight of component (a), 10 to 30% by weight of component (b) and 5 to 20% by weight of component (c); especially 60 to 70% of component (a), 20 to 30% of component (b) and 10 to 20% of component (c).

While the anionic surfactants may be used in conjunction with nonionic surfactants, at a weight ratio of anionic surfactant to nonionic surfactant of 9:1 to 0.1:1, the anionic surfactant(s) will generally constitute the major portion of the surfactants utilized in the detergent composition, preferably 60 to 90% by weight of the total surfactant content, most preferably 70 to 80%. The remaining portion of the surfactants utilized in the detergent composition, preferably 10 to 40% by weight of the total surfactant content, most preferably 20 to 30% may comprise a nonionic surfactant. The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergent employed is preferably a poly-lower alkoxylated higher alkanol wherein the alkanol has 8 to 22 carbon atoms, preferably 10 to 18 carbon atoms, and wherein the number of moles of lower alkylene oxide (of 2 or 3 carbon atoms) is from 3 to 20. Of such materials it is preferred to employ those wherein the higher alkanol is a higher fatty alcohol of 11 to 15 carbon atoms and which contain from 5 to 13 lower alkoxy groups per mole. Preferably, the lower alkoxy group is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 7 ethylene oxide groups per mole, e.g. Neodol® 25-7 and Neodol® 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups per mole averages about 6.5. The higher alcohols are primary alkanols. Other examples of such detergents include Tergitol® 15-S-7 and Tergitol® 15-S-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product but with nine moles of ethylene oxide being reacted.

Highly preferred nonionics useful in the present compositions are the higher molecular weight nonionic detergents, such as Neodol® 45-11, which are similar ethylene oxide condensation products of higher fatty alcohols, the higher fatty alcohol being of 14 to 15 carbon atoms and the number of ethylene oxide groups per mole being about 11. Such products are also made by Shell Chemical Company.

Since the nonionic surfactant compounds are often only sparingly soluble in water or form viscous solutions or gels when added to water they are usually made available in the form of organic solvent solutions, for example, in ethanol or isopropanol, alone or together with water.

The combined anionic and nonionic surfactants generally comprise from about 1 to 60% by weight, for example 1 to 40% by weight of the total fine fabric detergent composition, preferably 5 to 30%, most preferably 10 to 20%.

Any sugar, esterified with at least one long chain fatty acid, may be used as a softening and whitening agent in the present composition. Fatty acids having at least 10 carbon atoms or more being preferred, most preferable are fatty acids of 12 to 22 carbon atoms, with stearic acid being especially preferred. It is to be understood that the hydrophilic head group can be any sugar derivative such as, for example, glucose, fructose or sucrose and variations thereof will be apparent to those skilled in the art. Unlike polyethyleneoxide based nonionic surfactants, the hydrophilic/lipophilic balance (HLB) of sugar derivatives is adjusted by the number of hydrocarbon chains per sugar unit rather than by the hydrophilic chain length. Preferably, the sugar esters of the present invention have an HLB of from 7 to 16. Sugar esters may be incorporated into any detergent composition, liquid or powdered, especially those containing a nonionic surfactant.

The present detergent compositions may contain from about 1 to 20%, for example, from about 1 to 10% by weight of sugar ester(s), preferably 2 to 8%, most preferably 3 to 6%.

The invention detergent compositions also include water-soluble and/or water-insoluble detergent builder salts. Typical suitable builders include, for example, those disclosed in U.S. Pat. Nos. 4,316,812; 4,264,466 and 3,630,929. Water-soluble inorganic alkaline builder salts which can be used along with the detergent compound or in admixture with other builders are alkali metal carbonates, borates, phosphates, polyphosphates, bicarbonates, and silicates. Ammonium or substituted ammonium salts can also be used. Specific examples of such salts are sodium tripolyphosphate, sodium carbonate, sodium tetraborate, sodium pyrophosphate, potassium pyrophosphate, sodium hexametaphosphate, and potassium bicarbonate. Sodium tripolyphosphate (TPP) is especially preferred. The alkali metal silicates are useful builder salts which also function to make the composition anticorrosive to washing machine parts. Sodium silicates of $Na_2O/SiO_2$ ratios of from 1.6/1 to 1/3.2, especially about ½ to 1/2.8 are preferred. Potassium silicates of the same can also be used.

Another class of builders highly useful herein are the water-insoluble aluminosilicates, both of the crystalline and amorphous type. Various crystalline zeolites (i.e. aluminosilicates) are described in British Patent 1,504,168, U.S. Pat. No. 4,409,136 and Canadian Patents 1,072,835 and 1,087,477. An example of amorphous zeolites useful herein can be found in Belgium Patent 835,351. The zeolites generally have the formula $$(M_2O)_x \cdot (Al_2O_3)_y \cdot (SiO_2)_z \cdot WH_2O$$

where x is 1, y is from 0.8 to 1.2 and preferably 1, z is from 1.5 to 3.5 or higher and preferably 2 to 3 and W is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meg/g.

Other materials such as clays, particularly of the water-insoluble types, may be useful adjuncts in compositions of this invention. Particularly useful is bentonite. This material is primarily montmorillonite which is a hydrated aluminum silicate in which about 1/6th of the aluminum atoms may be replaced by magnesium atoms and with which varying amounts of hydrogen, sodium, potassium, calcium, etc. may be loosely combined. The bentonite in its more purified form (i.e. free from grit, sand, etc.) suitable for detergents invariably contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patents 401,413 and 461,221.

Examples of organic alkaline sequestrant builder salts which can be used along with the detergent or in admixture with other organic and inorganic builders are alkali metal, ammonium or substituted ammonium, aminopolycarboxylates, e.g. sodium and potassium nitrilotriacetates (NTA) and triethanolammonium N-(2-hydroxyethyl)nitrileodiacetates. Mixed salts of these polycarboxylates are also suitable.

Other suitable builders of the organic type include carboxymethylsuccinates, tartronates and glycollates.

Of special value are the polyacetal carboxylates. The polyacetal carboxylates and their use in detergent compositions are described in U.S. Pat. Nos. 4,144,226; 4,315,092 and 4,146,495. Other U.S. Pat. Nos. on similar builders include 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0,015,024; 0,021,491 and 0,063,399.

Since the compositions of this invention are generally highly concentrated, and, therefore, may be used at relatively low dosages, it is desirable to supplement any phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of SOKOLAN CP5 which is a copolymer of about equal moles of methacrylic acid and maleic anhydride, completely neutralized to form the sodium salt thereof.

The detergent builder salts may be present in the inventive detergent compositions in an amount of from 1 to 25%, for example, from about 1 to 20% by weight, preferably 5 to 15%.

In addition to detergent builders, various other detergent additives or adjuvants may be present in the detergent product to give it additional desired properties, either of functional or aesthetic nature. Thus, there may be included in the formulation, minor amounts of soil suspending or antiredeposition agents, e.g. polyvinyl alcohol, fatty amides, sodium carboxymethyl cellulose, hydroxy-propyl alcohol methyl cellulose; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidene sulfone, etc., most preferred are stilbene and triazole combinations.

Bluing agents such as ultramarine blue; enzymes, preferably proteolytic enzymes, such as subtilisin, bromelin, papain, trypsin and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose (CMC), complex of $C_{12}$ to $C_{22}$ alkyl alcohol with $C_{12}$ to $C_{18}$ alkylsulfate; perfume; and anti-foam agents or suds-suppressors, e.g. silicon compounds can also be used.

In a preferred embodiment of the invention wherein the composition is an aqueous liquid composition, the composition may further include an alkaline material selected from the group consisting of alkanolamines, alkyl amines, ammonium hydroxide and alkali metal hydroxides. Of these, the preferred materials are the alkanolamines, especially the trialkanolamines and of these, especially triethanolamine. The pH of the final liquid detergent, containing such an alkaline material, will usually be neutral or slightly basic. Satisfactory pH ranges are from 7 to 10, preferably about 7.5 to 9.5. In the wash water, the pH will usually be in this range or might be slightly more acidic, as by 0.5 to 1 pH unit, due to the organic acid content of soiled laundry.

Typically, the alkaline material may be present in an amount of from 0.1 to 5% by weight of the composition, preferably 0.5 to 3%.

Such aqueous liquid compositions may also include a hydrotrope to inhibit phase separation. Suitable hydrotropes include alkali metal, ammonium and alkanol ammonium salts of lower alkyl aryl sulfonates such as xylene-, toluene-, ethylbenzene- and isopropylbenzenesulfonates.

Typically, the hydrotrope may be present in an amount of from 0.5 to 10% by weight, preferably 1 to 6%, of the total composition.

The percentage of water, the main solvent in the preferred liquid compositions of the present invention (exempting the nonionic surfactant, which is usually liquid), will be from 20 to 85%, preferably 30 to 70% and most preferably 35 to 65%.

Suitable ranges of the optional detergent additives are: enzymes—0 to 2%, especially 0.7 to 1.3%; corrosion inhibitors—about 0 to 40%, and preferably 5 to 30%; anti-foam agents and suds-suppressors—0 to 15%, preferably 0 to 5%, for example 0.1 to 3%; soil suspending or anti-redeposition agents and anti-yellowing agents—0 to 10%, preferably 0.5 to 5%; colorants, perfumes, brighteners and bluing agents total weight 0% to about 2% and preferably 0% to about 2% and preferably 0% to about 1%. In the selections of the adjuvants, they will be chosen to be compatible with the main constituents of the detergent composition.

The fine fabric detergent compositions of the present invention may be provided in either powdery or liquid form. When provided in liquid form, the compositions are preferably aqueous liquids.

The compositions may be prepared in powdery form by spray-drying a heated aqueous slurry containing the ingredients described and having a solids content of about 60% (i.e. a total moisture content of about 40%). The slurry is prepared by vigorous agitation in a crutcher and is at a temperature of about 60° C. In making the slurry, the phosphate (supplied as potassium tripolyphosphate) is added last, just before spraying.

The slurry is sprayed into a spray tower countercurrent to a stream of heated air. The air enters the base of the tower at a temperature in the range of about 290° or 310° to 370° C. and leaves at about 80° to 105° C. During spray drying there are formed granules of hollow beads, some being in the form of individual beads and most being in the form of clusters of such beads.

In a preferred embodiment, the present fine fabric detergent composition may be formulated as an aqueous liquid. In this case, the aqueous liquid material can be prepared by simple manufacturing techniques which do not require any complicated equipment or expensive operations. In a typical manufacturing method the optical brightener may be slurried in water together with a small amount of triethanolamine, which helps to dissolve the suspended material. Addition of the surfactants usually results in the remainder of the brightener dissolving. Agitation is continued for about 5 to 10 minutes and then other adjuvants may be added, followed by perfume and dye. All of these operations may be effected at room temperature, although suitable temperatures within the range of 20° to 50° C. may be employed, as desired, with the proviso that when volatile materials, such as perfume, are added, the temperature should be low enough so as to avoid objectionable losses. Addition of the various adjuvants may be effected at suitable points in the process but for the most part these will be added to the final product or near the end of the process.

In this application, all proportions and percentages are by weight unless otherwise indicated. The following example is provided solely for illustrative purposes and should not be construed as limiting the present invention.

EXAMPLE

The formulations listed in Table I were prepared by mixing the ingredients in water.

TABLE I

| Ingredient | Formulation I | II | III |
|---|---|---|---|
| LAS[1)] | 8.55 | 8.55 | 8.55 |
| Coco Acid[2)] | 3.17 | 3 17 | 3.17 |
| Fatty Alcohol EO 7:1[3)] | 4.80 | 4.80 | 4.80 |
| $C_{12}$–$C_{14}$ Alcohol EO 2:1 Na Sulfate[4)] | 1.63 | 1.63 | 1.63 |
| KXS[5)] | 4.50 | 4.50 | 4.50 |
| S-1670[6)] | — | 5.00 | — |
| S-970[7)] | — | — | 5.00 |
| TKPP[8)] | 10.30 | 10.30 | 10.30 |
| TEA[9)] | 2.24 | 2.24 | 2.24 |
| Opacifier | 0.38 | 0.38 | 0.38 |
| Perfume | 0.40 | 0.40 | 0.40 |
| Optical Brightener | 0.06 | 0.06 | 0.06 |
| Dye | 0.0001 | 0.0001 | 0.0001 |
| Water | Q.S. | Q.S. | Q.S. |

Figure 2:
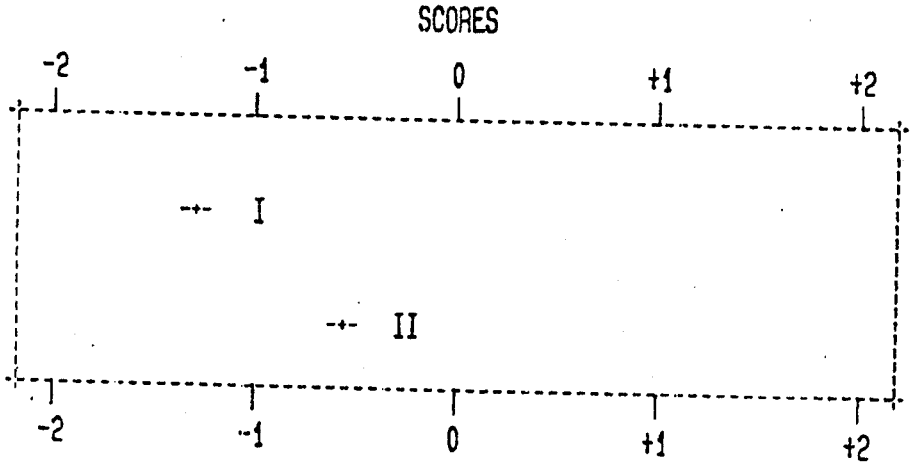
FIG. 2 is a graphical illustration of whiteness/redeposition values of fine fabric detergent compositions on cotton/polyester blend.
Figure 3:
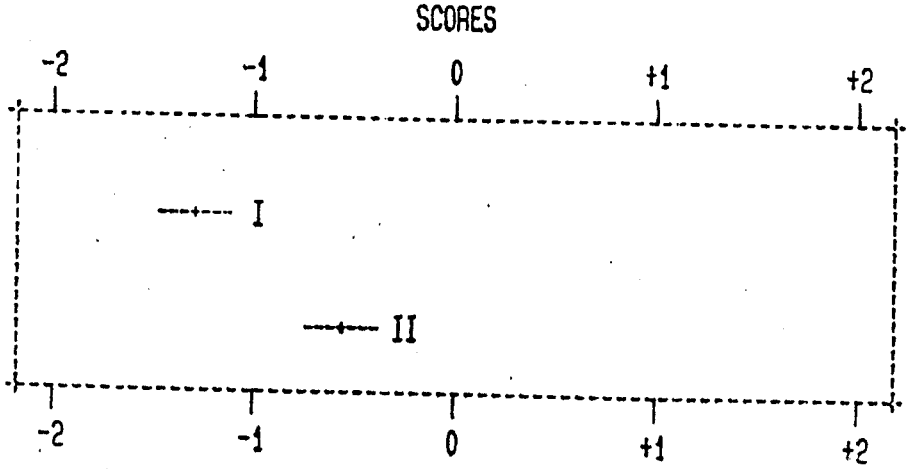
FIG. 3 is a graphical illustration of whiteness/redeposition values of fine fabric detergent compositions on wool.
Figure 4:
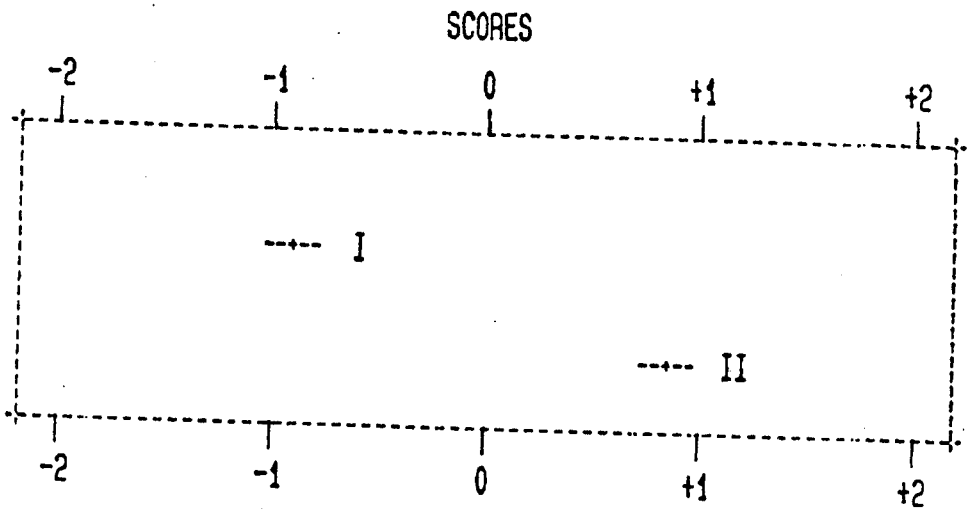
FIG. 4 is a graphical illustration of whiteness/redeposition values of fine fabric detergent compositions on polyester.
Figure 5:
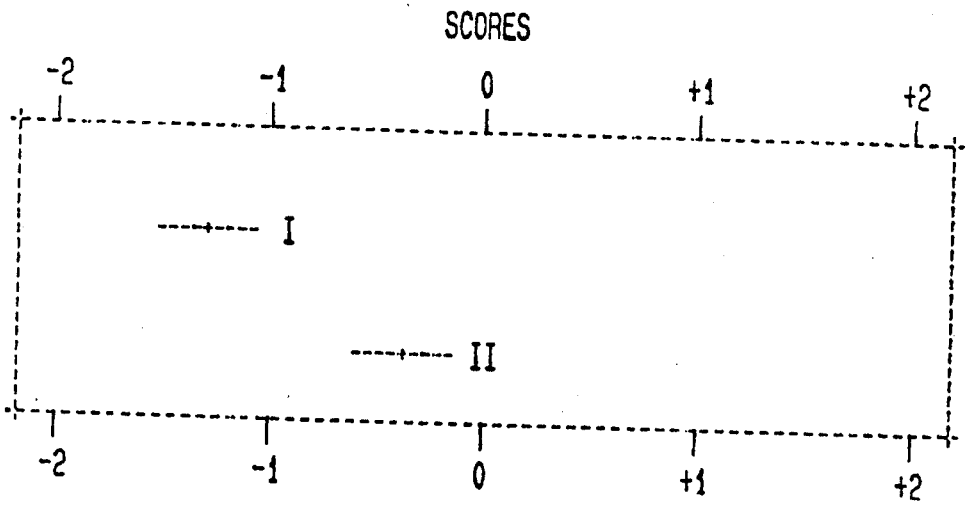
FIG. 5 is a graphical illustration of softening values of fine fabric detergent compositions on desized terry cloth.

[1)]higher alkyl benzene sulfonate-anionic surfactant
[2)]soap former-anionic surfactant
[3)]polyethoxylated higher alkanol (7 moles of ethylene oxide per mole of higher alkanol)-nonionic surfactant
[4)]sodium salt of sulphated ethoxylated $C_{12}$–$C_{14}$ alcohol (2 moles of ethylene oxide per mole of $C_{12}$–$C_{14}$ alcohol)
[5)]potassium xylene sulfonate-hydrotrope
[6)]Ryoto sugar ester S-1670 (Ryoto)-stearic acid derivative, HLB = 16
[7)]Ryoto sugar ester S-970 (Ryoto)-stearic acid derivative, HLB = 9
[8)]potassium tripolyphosphate-builder
[9)]triethanol amine-pH control agent and for LAS-TEA salt formation Formulations I and II were subjected to identical Miniwascator tests (40° C.; 6 cycles; 200 ppm water hardness; dosage: 6 g/l; load: white tracers and soiled fabrics) to evaluate softening and whitening (visual evaluation). The results are shown in FIGS. 1–5, wherein FIG. 1 compares whitening of cotton, FIG. 2 compares whitening of cotton/polyester blend, FIG. 3 compares whitening of wool, FIG. 4 compares whitening of polyester, and FIG. 5 compares softening of desized terry cloth.

Formulations I and III were also subjected to identical miniwascator tests (40° C.; 6 cycles; 200 ppm water hardness; dosage: 6 g/l; load: desized terry clothes) to evaluate whitening (Gardener XL 800). The results are shown in Table II.

TABLE II

| Formulation | Average RD Value |
|---|---|
| I | 74.9 |
| III | 80.7 |

What is claimed is:

1. A non-bleaching fine fabric detergent composition comprising:

a detersively effective amount of a surfactant mixture of anionic and nonionic surfactants, said mixture having a ratio of anionic surfactant to nonionic surfactant of from 9:1 to 0.1:1, by weight;

a detergent building effective amount of at least one builder salt; and a softening and whitening effective amount of a sugar ester containing at least one fatty acid chain having at least 10 carbon atoms.

2. The detergent composition according to claim 1, wherein said anionic surfactant comprises about 60 to about 90% by weight of said mixture of anionic and nonionic surfactants.

3. The detergent composition according to claim 1, wherein said anionic surfactant comprises about 70 to about 80% by weight of said mixture of anionic and nonionic surfactants.

4. The detergent composition according to claim 1, wherein said anionic surfactant comprises a higher alkyl mononuclear aromatic sulphonate, wherein said higher alkyl group contains 10 to 16 carbon atoms and said mononuclear aromatic group contains 6 to 9 carbon atoms.

5. The detergent composition according to claim 1, wherein said anionic surfactant comprises a soap of a fatty acid containing from about 8 to 20 carbon atoms.

6. The detergent composition according to claim 1, wherein said anionic surfactant comprises a sulphated ethoxylated higher fatty alcohol of the formula $$RO(C_2H_4O)_mSO_3M$$

wherein R represents a fatty alkyl group of from 10 to 18 carbon atoms, m is from 2 to 6, and M is a solubilizing salt-forming cation.

7. The detergent composition according to claim 1, wherein said anionic surfactant comprises a mixture of (a) from about 50 to 85% by weight of a higher alkyl mononuclear aromatic sulphonate, wherein said higher alkyl group contains 10 to 16 carbon atoms and said mononuclear aromatic group contains 6 to 9 carbon atoms;

(b) from about 10 to 30% by weight of a soap of a fatty acid containing from about 8 to 20 carbon atoms; and (c) from about 5 to 20% by weight of a sulphated ethoxylated higher fatty alcohol of the formula $$RO(C_2H_4O)_mSO_3M$$

wherein R represents a fatty alkyl group of from 10 to 18 carbon atoms, m is from 2 to 6, and M is a solubilizing salt-forming cation.

8. The detergent composition according to claim 7, wherein said component (a) is present in an amount of from about 60 to 70% by weight, said component (b) is present in an amount of from about 20 to 30% by weight, and said component (c) is present in an amount of from about 10 to 20% by weight.

9. The detergent composition according to claim 1, wherein said nonionic surfactant comprises a poly-lower alkoxylated higher alkanol wherein the alkanol has 8 to 22 carbon atoms and the number of moles of lower alkylene oxide is from 3 to 20 for each mole of higher alkanol.

10. The detergent composition according to claim 9, wherein said nonionic surfactant comprises an alkanol of 10 to 18 carbon atoms and the number of moles of lower alkylene oxide is from 5 to 13 for each mole of higher alkanol.

11. The detergent composition according to claim 10, wherein said nonionic surfactant comprises an alkanol of 11 to 15 carbon atoms and the lower alkylene oxide is ethylene oxide.

12. The detergent composition according to claim 1, wherein said sugar ester is a glucose ester.

13. The detergent composition according to claim 1, wherein said fatty acid has 8 to 22 carbon atoms.

14. The detergent composition according to claim 13, wherein said fatty acid has 10 to 18 carbon atoms.

15. The detergent composition according to claim 14, wherein said fatty acid is stearic acid.

16. The detergent composition according to claim 1, wherein said composition is an aqueous liquid composition.

17. The detergent composition according to claim 16, further comprising an alkaline material selected from the group consisting of alkanolamines, alkyl amines, ammonium hydroxide and alkali metal hydroxides, in an amount sufficient to provide a pH of from 7 to 10 for the liquid composition.

18. The detergent composition according to claim 17, wherein said alkaline material comprises an alkanolamine.

19. The detergent composition according to claim 16, further comprising a stabilizing effective amount of a hydrotrope selected from the group consisting of alkali metal, ammonium and alkanol ammonium salts of lower alkyl aryl sulphonates.

20. The detergent composition according to claim 19, wherein said hydrotrope comprises an alkali metal salt of a lower alkyl aryl sulphonate.

* * * * *